US006056148A

United States Patent [19]

Ferguson et al.

[11] Patent Number: 6,056,148

[45] Date of Patent: May 2, 2000

[54] TOY BOX

[76] Inventors: Gail A. Ferguson, 450 Loghouse Ct.; Jackie H. McMillan, 435 Loghouse Ct., both of Roswell, Ga. 30075

[21] Appl. No.: 08/967,859

[22] Filed: Nov. 12, 1997

[51] Int. Cl.[7] ..... B65D 8/00; B65D 8/06

[52] U.S. Cl. ..... 220/676; 220/297

[58] Field of Search ..... 206/457, 736, 206/756, 771, 751; 220/4.25, 4.33, 213, 255, 256, 293, 297, 345.1, 368, 373, 374, 581, 628, 630, 755, 770, 772

[56] References Cited

U.S. PATENT DOCUMENTS

| | | | |
|---|---|---|---|
| 220,871 | 10/1879 | Rutschman | 220/295 X |
| D. 305,247 | 12/1989 | Ukisu . | |
| D. 306,182 | 2/1990 | Ukisu . | |
| D. 306,187 | 2/1990 | Ukisu . | |
| D. 324,085 | 2/1992 | Morton . | |
| D. 328,201 | 7/1992 | Ryan . | |
| 681,320 | 8/1901 | Hood | 220/297 X |
| 2,515,715 | 7/1950 | Jones | 220/4.25 X |
| 3,022,969 | 2/1962 | Fleckenstein | 248/671 X |
| 4,106,657 | 8/1978 | Dogliotti . | |
| 5,046,587 | 9/1991 | Jones | 220/346.11 X |
| 5,152,414 | 10/1992 | Kruger | 220/4.33 |
| 5,295,598 | 3/1994 | Gerlach et al. | 220/630 X |
| 5,457,031 | 10/1995 | Masse | 220/4.28 X |
| 5,470,747 | 11/1995 | Sikorski | 220/4.25 X |

FOREIGN PATENT DOCUMENTS

| | | |
|---|---|---|
| 2315246 | 1/1977 | France . |
| 388079 | 1/1924 | Germany . |
| 9438 | 6/1889 | United Kingdom . |

*Primary Examiner*—Allan N. Shoap
*Assistant Examiner*—Joe Merek
*Attorney, Agent, or Firm*—Kenneth L Tolar

[57] ABSTRACT

A new and improved toy box structure includes a transparent, hollow spherical member having an interior chamber for receiving toys and an aperture on its exterior surface in communication therewith. The aperture is selectively enclosable using a removable disc shaped lid. Recessed handles are diametrically disposed on the exterior surface of the spherical member which may be grasped by a user. The spherical member is supported by a ramp style base component. The unique design of the device allows it to be easily rolled from one location to another and allows a child to view toys stored therein without having to remove the lid. Also, the unique design allows a user to manipulate the device to locate and remove a desired item without removing the other similarly stored items.

9 Claims, 3 Drawing Sheets

TOY BOX

BACKGROUND OF THE INVENTION

The present invention relates to a transparent toy box having a unique aesthetic appearance which may be easily transported from one location to another and which allows a child to view the contents therein without opening the device. The device is particularly suited to store and display toy items commonly referred to as Beanie Babies ® and similar small toy items.

DESCRIPTION OF THE PRIOR ART

Various toy box designs and constructions are well known in the prior art. Such devices typically comprise a box type structure or a substantially rectangular, clam shell type carrying case for receiving toys. Sometimes the device include a plurality of separate varying shaped storage compartments therein for receiving individual toy items. The devices are typically enclosable using a lid or detachable cover.

A long standing problem with the conventional toy boxes has been that such devices are often filled with numerous toys. Accordingly, whenever a child opens the toy box to search for a particular item, he or she typically must remove a substantial number of toys to find the desired item. The child usually leaves the removed toys scattered about the immediate area resulting in significant clutter and posing a tripping hazard to those walking nearby. Additionally, whenever the conventional toy boxes are filled with toys, they are often extremely heavy and therefore difficult to carry. Although most are equipped with one or more handles, even a partially filled toy box can be impossible for a small child to carry from one location to another.

Most patents relating to toy boxes involve unique ornamental designs therefor. For example, U.S. Pat. No. 4,106,657 issued to Dogliotti relates to a container usable as a toy construction element comprising a pair of cup shaped members which are selectively engagable using a snap mechanism. Within the cup shaped members is a gift or novelty item. A first cup member has a plurality of holes on its side wall and a hole on its bottom surface while a second cup member has a plurality of holes on its side wall with a projection extending from the bottom surface thereof. The projection may mutually engage any of the apertures on a similar cup member allowing the individual cup members to be collected and attached to form a desired configuration. Accordingly, the device may be kept and used as a toy construction element after the contents have been removed and used.

U.S. Pat. No. Des. 328,201 issued to Ryaa relates to an ornamental design for a toy box comprising a substantially box type container with a handle projecting from a side thereof. The container has a plurality of apertures on its top surface and a substantially medial, vertical dividing wall therein.

U.S. Pat. No. Des. 324,085 issued to Morton relates to an ornamental design for a toy box comprising a pair of substantially trapezoidal side walls with substantially rectangular bottom, front and rear sidewalls perpendicularly disposed therebetween. A lid component and several recessed handles are also provided.

U.S. Pat. No. Des. 306,187 issued to Ukisu relates to an ornamental design for a simulative toy box as pictured therein. The device apparently comprises two hingedly engaging components each having a unique configuration received within which are with various compartments and projections.

U. S. Pat. No. Des. 306,182 issued to Ukisu relates to an ornamental design for a simulative toy box as pictured therein. The device comprises two hingedly engaging components, each having a substantially square configuration. One of said components is substantially hollow with a vertical dividing wall therein.

U.S. Pat. No. Des. 305,247 issued to Ukisu relates to an ornamental design for a simulative toy box as shown and described therein. The device likewise comprises two hingedly engaging substantially square components, one of which has a rectangular chamber with compartments therein. As indicated above, none of the prior art toy box constructions relate to a transparent toy box which may be easily rolled from one location to another.

SUMMARY OF THE INVENTION

The present invention relates to a new and improved toy box which overcomes the above described disadvantages of conventional toy boxes by providing a substantially hollow, transparent, spherical toy receiving member having an aperture thereon. Removably received within the aperture is a disc shaped lid component having a convex exterior surface providing selective access to the interior thereof. On the exterior surface of the spherical member are at least two sets of longitudinal indentions in which a first set is diametrically opposed from the second set. The longitudinal indentions provide opposed recessed handles which may be grasped by a user. On the exterior surface of the lid component are a plurality of apertures in communication with the spherical member interior which function as air vents. The spherical member is supported by a ramp style base component having a concave upper surface. Instead of carrying the device, a user may transport it by rolling it to a desired location.

It is therefore an object of the present invention to provide a unique toy box structure which allows a user to view toys therein without opening the device.

It is yet another object of the present invention to provide a unique toy box structure which may be easily rolled to another location.

It is yet another object of the present invention to provide a unique toy box structure which may be selectively manipulated to access a desired toy item without removing all the contents therein.

It is yet another object of the present invention to provide a unique toy box structure having a unique, aesthetically pleasing appearance.

It is yet another object of the present invention to provide a unique toy box structure having an air venting means allowing the lid component to be easily removed therefrom. Other objects, features and advantages of the present invention will be readily apparent to those skilled in the art from the following detailed description of the preferred embodiment when considered with the attached drawings and the appended claims.

DESCRIPTION OF THE PREFERRED EMBODIMENT

Figure 1:
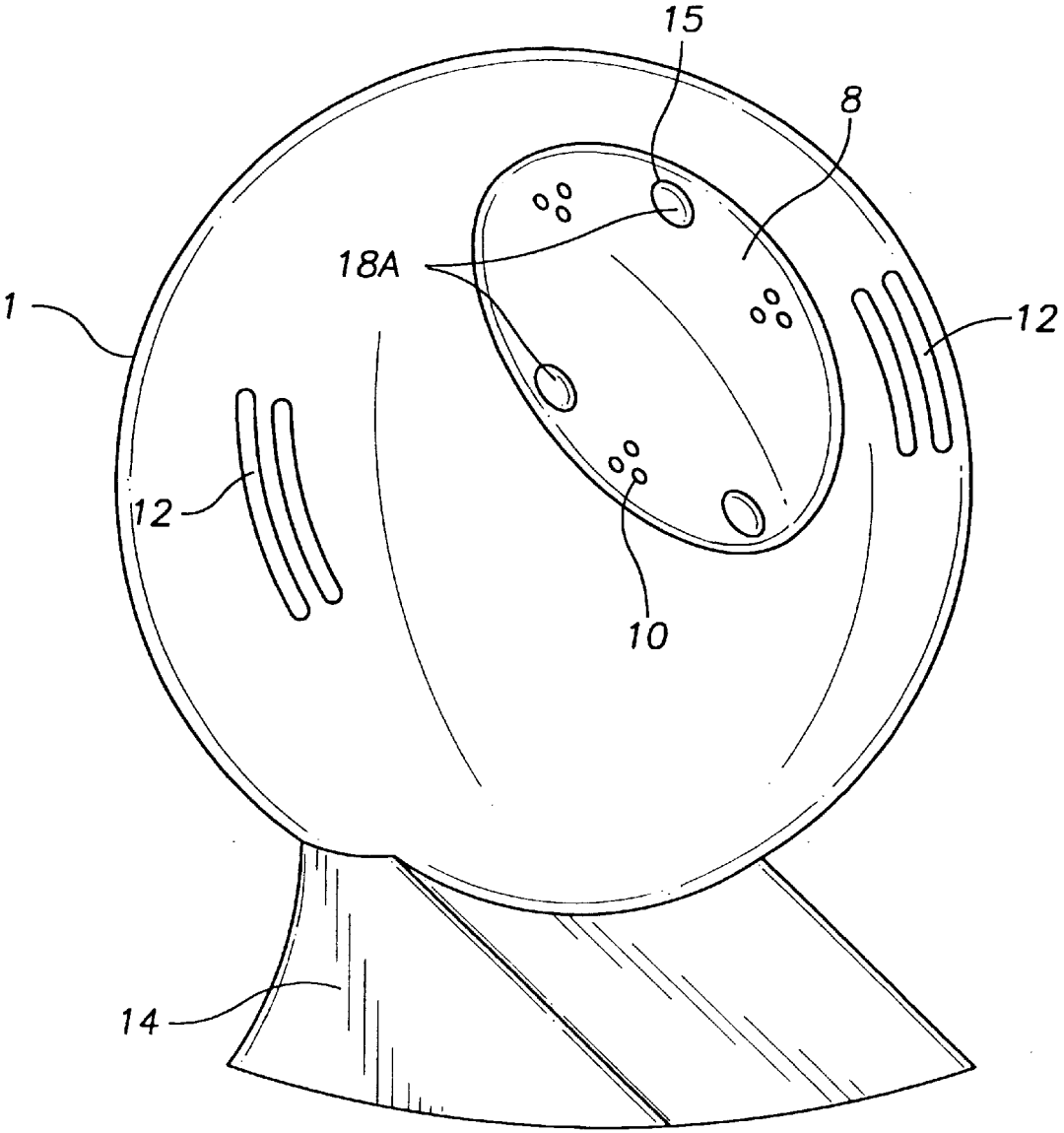
FIG. 1 is a perspective view of the inventive device.
Figure 2:
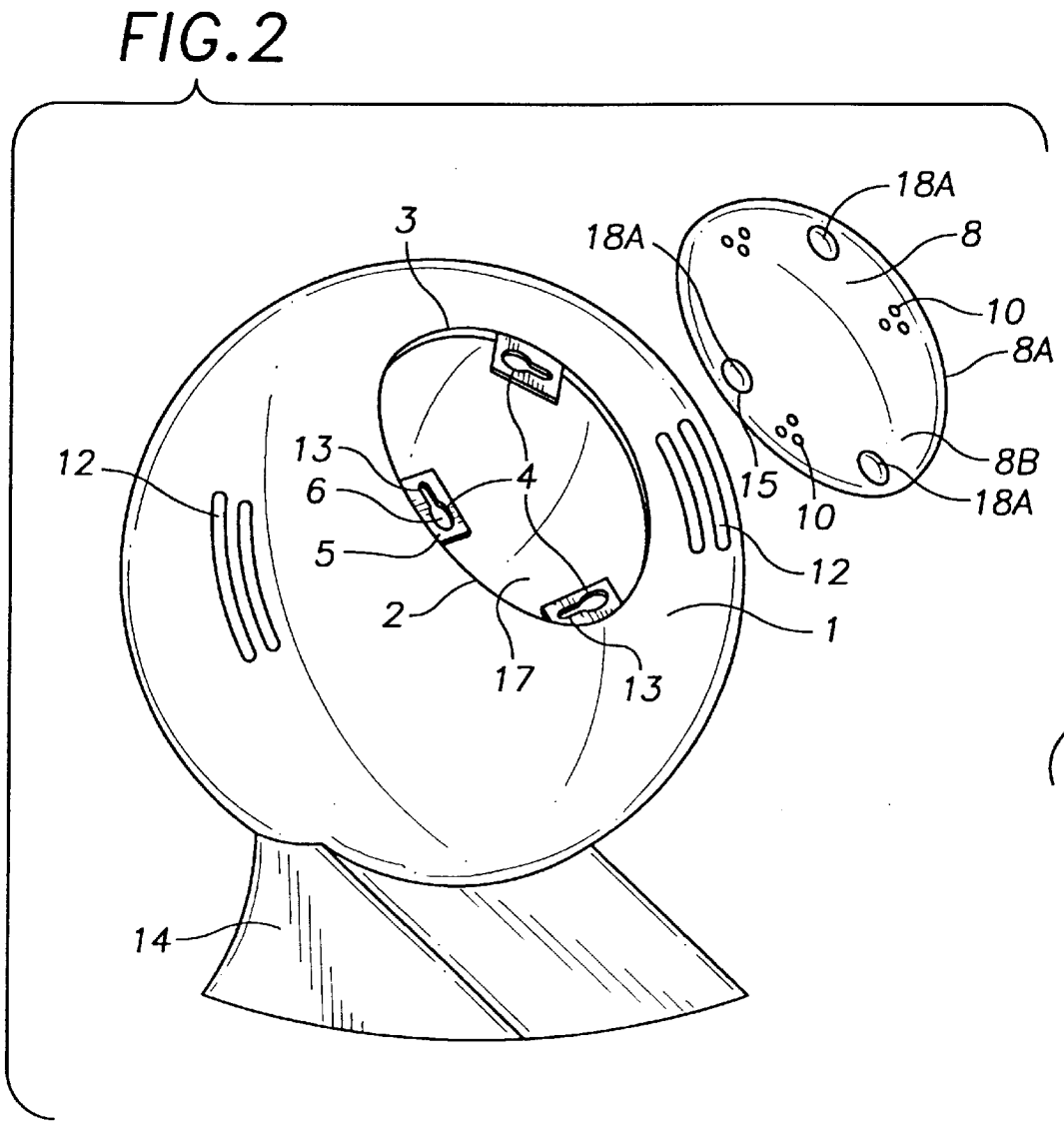
FIG. 2 is a perspective view of the inventive device with the removably attached lid component offset therefrom.
Figure 3:
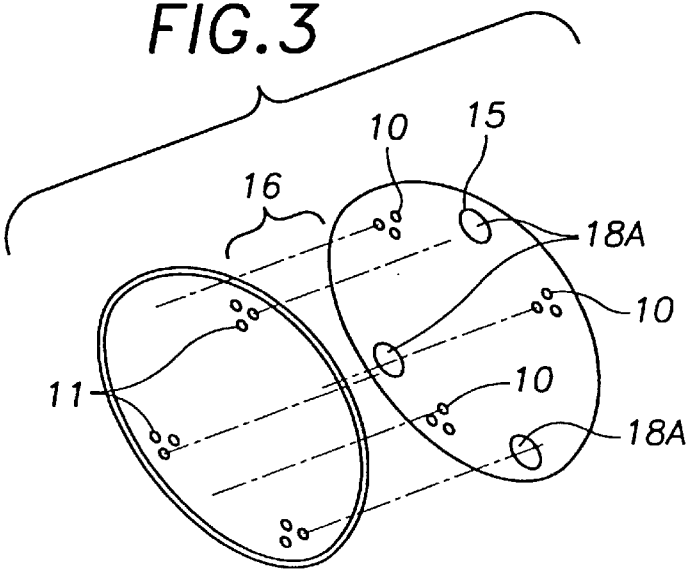
FIG. 3 depicts the two lid component layers and the offset air vents thereon.
Figure 5:
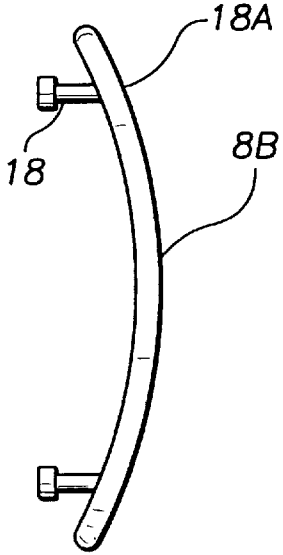
FIG. 5 is a side view of the lid component.
Figure 4:
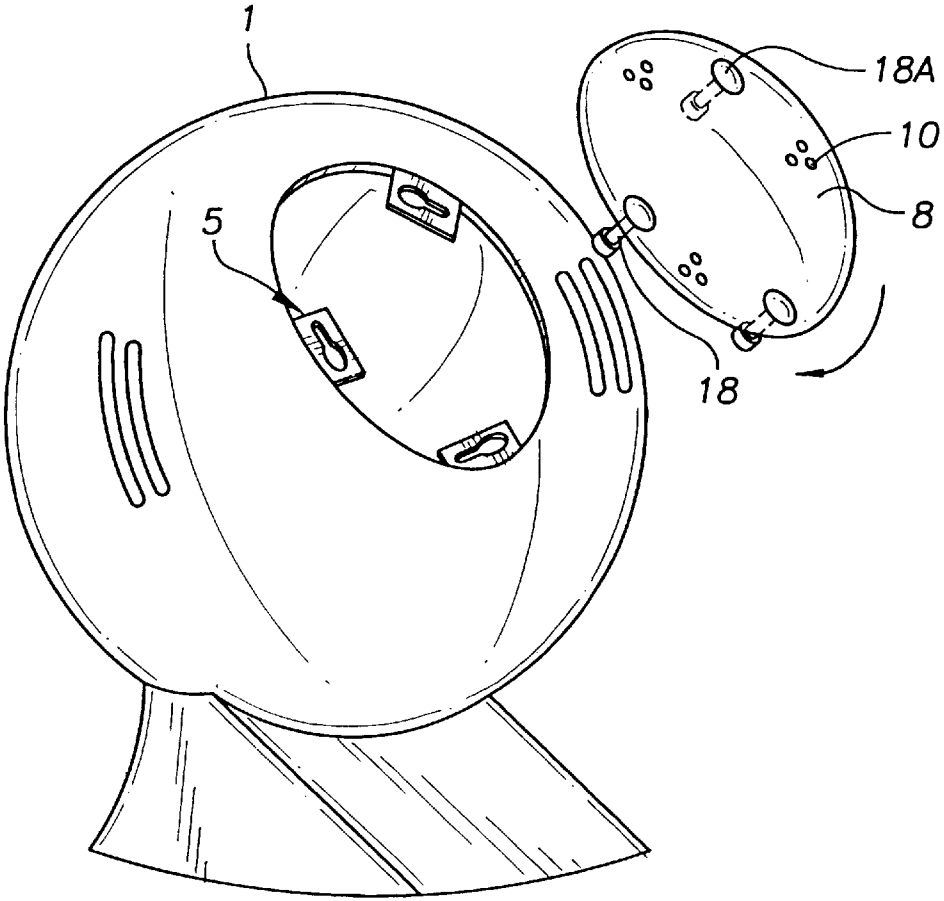
FIG. 4 depicts a slightly exploded view of the toy box thereby illustrating the rivets on the inner surface of the lid component.

Referring now to FIGS. 1 through 3, the present invention relates to a new and improved toy box structure comprising a substantially hollow, spherical member 1 having an exterior surface and an interior chamber 17 for receiving and storing toy items therein. The spherical member 1 is transparent and is preferably constructed with shatter resistant, clear polyethylene to provide a user with an instant, panoramic view of the contents therein. However, other similar transparent materials may be used. The spherical member 1 has an aperture 2 on its exterior surface in communication with the interior chamber 17. The aperture 2 has a substantially circular peripheral edge 3. Attached to the peripheral edge 3 are a plurality of female connectors 4. The connectors 4 comprise a planar plate 5 of stamped plastic or similar material. The planar plate 5 has a substantially circular aperture 6 in communication with a substantially longitudinal slot 13.

Removably received within the aperture 2 on the exterior surface of the spherical member is a disc shaped lid component 8 having a substantially circular peripheral edge 8A, an inner surface and a slightly convex exterior surface 8B. The convex surface 8B is configured so that it is an integral part of the spherical member 1 when the lid component 8 is placed within said aperture 6. The disc shaped lid component 8 preferably has a hollow, void space 16 between its exterior and inner surfaces.

On the exterior surface of the lid component 8 are a plurality of circular recessed holes 15 for receiving a rivet 18 having a first circular head 18A dimensioned to be received within said holes. A distal end of each rivet has a second head that extends through said lid component and protrudes from the inner surface thereof. The second head is received within the aperture 6 such that when the lid component is rotated, the arm connecting the two rivet heads slides within the longitudinal slot 13. The second rivet head is then disposed on the inwardly facing side of the longitudinal slot and thus prevents the lid from being removed. Accordingly, the lid component 8 may be secured to the spherical member 1 by inserting the rivets 18 into the apertures and rotating the lid component slightly to lock the lid component in place. Alternatively, the rivets may be integrally molded with said lid component 8.

Also on the exterior surface of the lid component 8 are a plurality of apertures 10 which are in communication with the void space 16 thereof. A plurality of similarly disposed apertures 11 are disposed on the inner surface 8A of the lid component 8 and are likewise in communication with the void space 16. The apertures on the exterior surface 10 are substantially misaligned with respect to the aperture on the inner surface 11 so that a small child cannot insert any fingers completely through the lid component 8 which could result in possible injury. The apertures 10,11 function as air vents to prevent a vacuum from being created within the device thus allowing the lid component 8 to be more easily removed.

On the exterior surface of the spherical member 1 are a plurality of indentions 12. Preferably, the indentions are arranged in two, diametrically opposed sets which function as recessed handles allowing the device to be easily carried.

The spherical member 1 is supported by a ramp style base component 14. The base component 14 has a planar bottom surface, three substantially vertical side walls and an oblique sidewall depending therefrom with a substantially concave upper surface. The spherical member 1 is received within the concave upper surface as depicted in FIG. 1.

To use the above described device, the lid component 8 is rotated slightly until the second rivet heads align with the planar plate apertures 6 and the lid is removed. Toys are then placed in the spherical member 1 and the lid 8 is replaced and rotated to lock the rivets within the planar plate. If the user wishes to transport the device, he or she may easily grasp the recessed handles 12 and carry it from one location to another. If the device cannot be carried, as in the case of a small child or if the device is filled and therefore very heavy, the enclosed spherical 1 member may be easily rolled off the ramp style base component 14 to a desired location. Furthermore, if a user wishes to remove a particular toy item therefrom, the transparent spherical member 1 may be grasped and rotated until the desired item is found. Similarly, the toy item may then be manipulated towards the lid component where it can be removed. Therefore, the unique combination of shape and transparency allows the user to find and remove a particular item without having to first open the device and remove some or all of the contents therein. In addition, the toy storage container simultaneously functions as a display for small speciality toys such as Beanie Babies®. Furthermore, the unique design allows the device to be easily transported by rolling it on the ground or floor.

As will be readily apparent to those skilled in the art, the individual components are manufactured with lightweight plastic so that the device will be both durable and portable. However, many other similar or suitable materials may also be used. The dimensions of the various components may be varied to suit a particular application. Although there has been shown and described the preferred embodiment of the present invention, modifications may be made thereto which do not exceed the scope of the appended claims. Therefore, the scope of the invention is only to be limited by the following claims.

What is claimed is:

1. A toy box construction comprising:

a hollow, transparent spherical member having an interior chamber for receiving toy items and a lid aperture in communication with said interior chamber;

a disc shaped lid component having an exterior surface and an inner surface with an airspace therebetween, said lid component removably received within said lid aperture;

means for securing said lid within said lid aperture thereby providing a means for displaying and storing toy items;

a plurality of rivets extending from the inner surface of said lid component;

a plurality of connectors attached to a peripheral edge of said lid aperture of said spherical member for lockably engaging said rivets; wherein said lid component includes an air venting means whereby air may reversibly flow from the interior chamber to the atmosphere; wherein said air venting means comprises:

a plurality of venting apertures on the exterior surface of said lid component in communication with and offset from a plurality of venting apertures on the inner surface of said lid component.

2. A toy box construction according to claim 1 further comprising a pair of indentions on the exterior surface of said spherical member, said indentions defining recessed handles.

3. A toy box construction according to claim 1 further comprising a ramp style base component including a concave top surface configured to receive said spherical member and an oblique side wall on which said spherical member may be rolled to and from said top surface.

4. A toy box construction comprising:

a hollow, spherical member having an interior chamber for receiving toy items and a lid aperture in communication with said interior chamber;

a disc shaped lid component having an exterior surface and an inner surface with an air space therebetween, said lid component removably received within said lid aperture;

means for securing said lid component within said lid aperture;

a ramp style base component having a concave top surface for supporting said spherical member and an oblique side wall on which said spherical member may be rolled to and from said concave top surface;

a plurality of connectors attached to a peripheral edge of said lid aperture of said spherical member;

a plurality of rivets protruding from the inner surface of said lid component for lockably engaging said connectors; wherein said lid component includes an air venting means whereby air may reversibly flow from the interior chamber to the atmosphere; wherein said air venting means comprises:

a plurality of venting apertures on the exterior surface of said lid component in communication with and offset from a plurality of venting apertures on the inner surface of said lid component.

5. A toy box construction according to claim 4 further comprising a pair of diametrically opposed indentions on the exterior surface of said spherical member, said indentions defining recessed handles.

6. A toy box construction comprising:

a hollow, spherical member having an interior chamber for receiving toy items and a lid aperture in communication with said interior chamber;

a disc shaped lid component having an exterior surface and an inner surface with an air space therebetween, said lid component removably received within said lid aperture;

means for securing said lid component within said aperture;

a plurality of venting apertures on the exterior surface of said lid component in communication with and offset from a plurality of venting apertures on the inner surface of said lid component to provide an air passage from the interior chamber of the spherical member to the atmosphere.

7. A toy box construction according to claim 1 wherein said means for securing said lid component within said lid aperture comprises:

a plurality of connectors secured within the interior chamber of said spherical member and positioned adjacent said aperture;

a plurality of rivets protruding from the inner surface of said lid component for lockably engaging the connectors.

8. A toy box construction according to claim 1 further comprising at least two diametrically opposed indentions on the exterior surface of said spherical member, said indentions defining recessed handles.

9. A toy box construction according to claim 1 further comprising a ramp style base component having a concave top surface for receiving and supporting said spherical member and an oblique side wall on which said spherical member may be rolled to and from said concave top surface.

* * * * *